US009970142B2

(12) United States Patent
Kang

(10) Patent No.: US 9,970,142 B2
(45) Date of Patent: May 15, 2018

(54) WASHING MACHINE HAVING DETERGENT SUPPLY DEVICE AND METHOD OF CONTROLLING THE SAME

(71) Applicant: SAMSUNG ELECTRONICS CO., LTD., Suwon-si, Gyeonggi-do (KR)

(72) Inventor: Min Ji Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 14/313,033

(22) Filed: Jun. 24, 2014

(65) Prior Publication Data

US 2015/0033479 A1 Feb. 5, 2015

(30) Foreign Application Priority Data

Aug. 2, 2013 (KR) ..... 10-2013-0092213

(51) Int. Cl.
*D06F 33/02* (2006.01)
*D06F 35/00* (2006.01)
(Continued)

(52) U.S. Cl.
CPC ..... *D06F 33/02* (2013.01); *D06F 35/006* (2013.01); *D06F 39/02* (2013.01); *D06F 39/088* (2013.01);
(Continued)

(58) Field of Classification Search
CPC ..... D06F 33/02; D06F 39/02
See application file for complete search history.

(56) References Cited

U.S. PATENT DOCUMENTS 4,862,711 A * 9/1989 Ikeda ..... D06F 39/005 68/12.18
2007/0079637 A1* 4/2007 Song ..... D06F 39/02 68/17 R
(Continued)

FOREIGN PATENT DOCUMENTS

DE 19855503 6/2000
DE 102010028445 11/2011
(Continued)

OTHER PUBLICATIONS

Extended European Search Report dated Mar. 11, 2015 from European Patent Application No. 14172190.2, 6 pages.

*Primary Examiner* — Spencer E Bell
(74) *Attorney, Agent, or Firm* — Staas & Halsey LLP

(57) ABSTRACT

A washing machine that performs refresh washing in which smell or mold that permeates laundry can be removed, and a method of controlling the washing machine. When clothes that are kept for a long time without being worn or laundries that are hardly contaminated due to a short wearing time are washed, a refresh washing course in which various smell or mold that permeates laundry can be removed using a very small amount of detergent, is performed. Thus, overuse of detergent caused by an excessive use of detergent can be prevented, and since the necessity for rinsing is low due to the use of the very small amount of detergent, an intermediate dehydration operation may be omitted, or an intermediate dehydration revolutions per minute (rpm) may be reduced so that washing and rinsing operations do not need to be excessively performed and thus damage of laundry is reduced.

9 Claims, 10 Drawing Sheets

(51) Int. Cl.
*D06F 39/08* (2006.01)
*D06F 39/02* (2006.01)

(52) U.S. Cl.
CPC .. *D06F 2204/065* (2013.01); *D06F 2204/086* (2013.01); *D06F 2232/00* (2013.01)

(56) References Cited

U.S. PATENT DOCUMENTS

| | | | | |
|---|---|---|---|---|
| 2007/0101772 | A1* | 5/2007 | Duncan | D06F 17/10 68/3 R |
| 2010/0101030 | A1 | 4/2010 | Kim | |
| 2010/0236000 | A1* | 9/2010 | Kim | D06F 35/002 8/159 |
| 2012/0011659 | A1* | 1/2012 | Park | D06F 33/02 8/137 |
| 2012/0066928 | A1* | 3/2012 | Son | D06F 33/02 34/427 |

FOREIGN PATENT DOCUMENTS

| | | |
|---|---|---|
| EP | 1559826 | 8/2005 |
| EP | 2050859 | 4/2009 |
| EP | 2479334 | 7/2012 |
| EP | 2602380 | 6/2013 |

* cited by examiner

WASHING MACHINE HAVING DETERGENT SUPPLY DEVICE AND METHOD OF CONTROLLING THE SAME

CROSS-REFERENCE TO RELATED APPLICATIONS

This application claims the benefit of Korean Patent Application No. 10-2013-0092213, filed on Aug. 2, 2013 in the Korean Intellectual Property Office, the disclosure of which is incorporated herein by reference.

BACKGROUND

1. Field

Embodiments of the present disclosure relate to a washing machine having a detergent supply device that automatically puts in detergent and a method of controlling the washing machine.

2. Description of the Related Art

Washing machines are machines that each include a tub in which water (washing water or rinsing water) is stored, a drum that is rotatably installed in the tub and accommodates laundry, and a motor that generates a driving force for rotating the drum, thereby enabling washing by performing an operation of lifting and falling laundry inside the drum along an inner wall of the drum when the drum is rotated.

These washing machines perform washing through a series of operations, such as a washing operation in which contamination of laundry is removed using water (in detail, washing water) in which detergent is dissolved, a rinsing operation in which bubbles of laundry or the remaining detergent is rinsed using water (in detail, rinsing water) in which no detergent is included, and a dehydration operation in which laundry is dehydrated at a high speed.

In the washing operation among the above-described operations, detergent is put in the tub together with water (in detail, washing water) when water is supplied. In the related art, a user himself/herself puts detergent. However, recently, a washing machine includes a detergent supply device in which detergent is accommodated, so as to automatically put detergent.

The washing machine having the detergent supply device uses a washing method, whereby the weight of laundry is detected and then the amount of detergent set according to the detected weight of laundry is automatically put so as to remove contamination adsorbed into laundry.

However, when clothes that are kept for a long time without being worn or laundries that are hardly contaminated due to a short wearing time are washed, if the amount of detergent set according to the weight of laundry is put, an excessive amount of detergent compared to a degree of contamination of laundry is put such that a waste of detergent occurs. In addition, since washing and rinsing operations are excessively performed at a target revolutions per minute (rpm) and an operating rate (motor on-off time) that are set according to the weight of laundry, laundry is damaged and thus, the lifespan of laundry may be reduced.

Thus, a refresh concept of washing having no purpose of removing contamination adsorbed into laundry but removing various smell or mold that permeates laundry (clothes) is required.

SUMMARY

Therefore, it is an aspect to provide a washing machine having a detergent supply device that performs refresh washing in which smell or mold that permeates laundry can be removed, and a method of controlling the washing machine.

Additional aspects will be set forth in part in the description which follows and, in part, will be obvious from the description, or may be learned by practice of the invention.

In accordance with one aspect, a method of controlling a washing machine having a detergent supply device, the washing machine including a tub in which water is accommodated, a drum installed in the tub and accommodating laundry, a motor rotating the drum, a water supply device supplying water to the tub, and the detergent supply device supplying detergent to the tub, the method includes: putting a smaller amount of detergent than an amount of detergent for a standard washing course by operating the detergent supply device; supplying a larger amount of water than an amount of water supplied for the standard washing course by operating the water supply device; and performing a refresh washing course by operating the motor at a lower operating rate than an operating rate for the standard washing course.

In the refresh washing course, the detergent supply device may operate for a reference time regardless of a weight of the laundry so as to supply an amount of detergent.

The amount may be a very small amount of about 10 g.

In the refresh washing course, an operating rate of the motor may be lower than a motor operating rate for the standard washing course so that a washing operation and a rinsing operation are performed.

In the refresh washing course, an amount of water to be supplied for the washing operation may be larger than an amount of water to be supplied for the standard washing course.

The amount of water to be supplied for the refresh washing course may be greater than or equal to an amount of water to be supplied for a delicate course.

In the refresh washing course, water may be supplied up to a reference water level regardless of a weight of the laundry when water is supplied in the washing operation.

The reference water level may be a water level that corresponds to about ⅓ of a height of the tub.

In the refresh washing course, a time required for the washing operation may be shorter than a time required for the standard washing course.

In the refresh washing course, a time required for the rinsing operation may be shorter than a time required for the standard washing course.

In the refresh washing course, intermediate dehydration after the washing operation has been completed and intermediate dehydration after the rinsing operation has been completed, may be omitted.

Alternatively, in the refresh washing course, an intermediate dehydration speed after the washing operation has been completed and an intermediate dehydration speed after the rinsing operation has been completed, may be controlled to be lower than an intermediate dehydration speed in the standard washing course.

In the refresh washing course, the number of times being rinsed in the rinsing operation may be less than or equal to a reference number of times.

The reference number of times may be the number of times being rinsed for the standard washing course and may be about one time or more.

In accordance with an aspect, a washing machine includes: a tub in which water is accommodated; a drum installed in the tub and accommodating laundry; a motor rotating the drum; a water supply device supplying water to the tub; a detergent supply device supplying detergent to the tub; an input unit selecting a standard washing course in which contamination adsorbed into the laundry is removed, and a refresh washing course in which smell or mold that permeates the laundry is removed; and a controller, if the refresh washing course is selected, controlling the detergent supply device to put in a smaller amount of detergent than an amount of detergent for the standard washing course, controlling the water supply device to supply a larger amount of water than an amount of water to be supplied in the standard washing course, and controlling the motor to perform the refresh washing course at a lower operating rate than an operating rate for the standard washing course.

The controller may supply an amount of detergent by setting an operating time of the detergent supply device to be shorter than an operating time of the standard washing course.

The controller may perform the refresh washing course by setting a motor operating rate in the washing operation and a motor operating rate in the rinsing operation to be lower than a motor operating rate in the standard washing course.

The controller may perform the refresh washing course by setting an on operating time of the motor to be shorter than a motor on operating time for the standard washing course.

The controller may control the water supply device to supply a larger amount of water to be supplied in the washing operation than an amount of water to be supplied in the standard washing course.

The controller may control the water supply device to supply water up to a reference water level regardless of a weight of the laundry when water is supplied in the washing operation.

The controller may perform the refresh washing course by setting a time required for the washing operation to be shorter than a time required for the standard washing course.

The controller may perform the refresh washing course by setting a time required for the rinsing operation to be shorter than a time required for the standard washing course.

The controller may perform the number of times being rinsed in the rinsing operation to be less than or equal to the number of times being rinsed in the standard washing course.

The controller may perform the refresh washing course by omitting intermediate dehydration after the washing operation has been completed and intermediate dehydration after the rinsing operation has been completed.

In the alternative, the controller may perform the refresh washing course by controlling an intermediate dehydration speed after the washing operation has been completed and an intermediate dehydration speed after the rinsing operation has been completed, to be lower than an intermediate dehydration speed in the standard washing course.

In accordance with still an aspect, a method of controlling a washing machine having a detergent supply device, the washing machine including a tub in which water is accommodated, a drum installed in the tub and accommodating laundry, a motor rotating the drum, a water supply device supplying water to the tub, and the detergent supply device supplying detergent to the tub, the method includes: putting a smaller amount of fabric conditioner than an amount of fabric conditioner for a standard washing course by operating the detergent supply device; supplying a larger amount of water than an amount of water supplied for the standard washing course by operating the water supply device; and performing refresh rinsing by operating the motor at a lower operating rate than an operating rate for the standard washing course.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
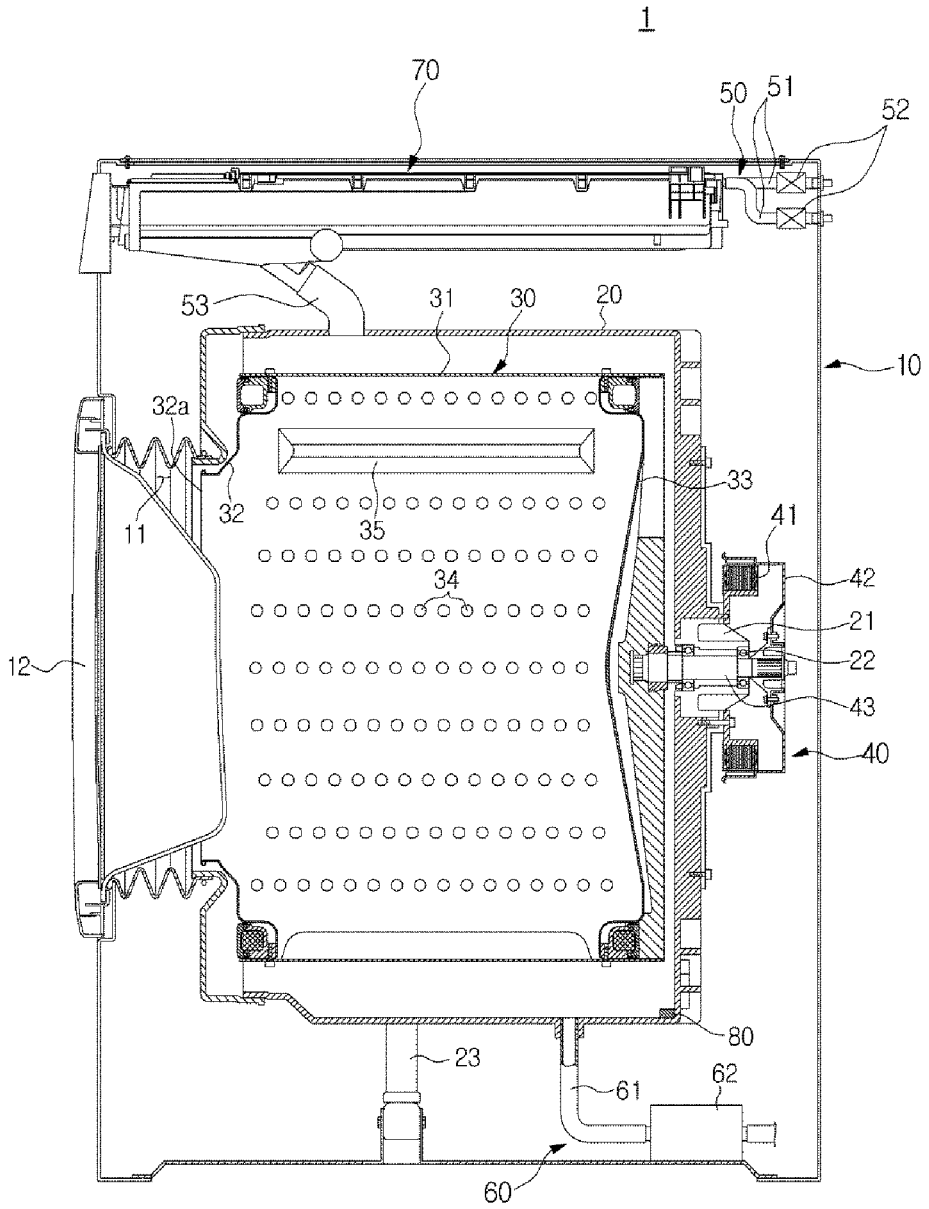
FIG. 1 illustrates a configuration of a washing machine in accordance with an embodiment.

Reference will now be made in detail to the embodiments, examples of which are illustrated in the accompanying drawings, wherein like reference numerals refer to like elements throughout.

FIG. 1 illustrates a configuration of a washing machine in accordance with an embodiment.

Referring to FIG. 1, a washing machine 1 in accordance with the current embodiment includes an approximately box-shaped main body 10 that constitutes the exterior, a tub 20 installed in the main body 10, a drum 30 that is rotatably installed in the tub 20, and a motor 40 that drives the drum 30.

A laundry port 11 through which laundry may be put into the drum 30, is disposed at a front side of the main body 10. The laundry port 11 is opened/closed by a door 12 installed at the front side of the main body 10.

The drum 30 includes a cylindrical part 31, a front panel 32 installed in front of the cylindrical part 31, and a rear panel 33 installed in rear of the cylindrical part 31. An opening 32*a* through which laundry is put in or taken out, is formed in the front panel 32, and a driving shaft 43 that transmits power of the motor 40, is connected to the rear panel 33.

A plurality of through holes 34 through which washing water flows, are formed in a circumference of the drum 30. A plurality of lifters 35 are installed at an inner circumferential surface of the drum 30 so that laundry may be lifted or fallen when the drum 30 is rotated.

The motor 40 includes a stator 41 fixed to a rear side of the tub 20, a rotator 42 that rotates while interlocking with the stator 41, and the driving shaft 43 having one end fixed to the center of the rotator 42 and the other end fixed to the center of the rear panel 33 of the drum 30 by perforating the tub 20.

Generally, the motor 40 is a universal motor including a field coil and an armature or a brushless direct (BLDC) motor including a permanent magnet and an electrical magnet. The motor 40 may be any type of motor 40 that may be applied to the drum 30.

The driving shaft 43 is installed between the drum 30 and the motor 40. One end of the driving shaft 43 is connected to the rear panel 33 of the drum 30, and the other end of the driving shaft 43 extends to an outer side of a rear wall of the tub 20. When the motor 40 drives the driving shaft 43, the drum 30 connected to the driving shaft 43 is rotated around the driving shaft 43.

A bearing housing 21 is installed at the rear wall of the tub 20 so as to rotatably support the driving shaft 43. The bearing housing 21 may be formed of an aluminum alloy and may be inserted into the rear wall of the tub 20 when the tub 20 is injection molded. Bearings 22 are installed between the bearing housing 21 and the driving shaft 43 in such a way that the driving shaft 43 may be smoothly rotated.

The tub 20 is supported by a damper 23. The damper 23 connects an inner bottom surface of the main body 10 and an outer side of the tub 20.

A water supply device 50 for supplying water to the tub 20 and a detergent supply device 70 that is connected to the water supply device 50 and causes water supplied via the water supply device 50 to be supplied to the tub 20 together with detergent are installed above the tub 20. A drainage device 60 is installed below the tub 20 so as to discharge water in the tub 20 toward an outer side of the main body 10.

The water supply device 50 includes a water supply pipe 51 that connects an external water supply source (not shown) and the detergent supply device 70 so as to supply water (washing water or rinsing water) into the tub 20, a water supply valve 52 that is installed in the middle of the water supply pipe 51 and controls the supply of water, and a connection pipe 53 that connects the tub 20 and the detergent supply device 70.

The drainage device 60 includes a drainage pipe 61 that guides water in the tub 20 to be discharged toward the outer side of the main body 10, and a drainage pump 62 that is installed at the drainage pipe 61 and causes water to be discharged through the drainage pipe 61.

The detergent supply device 70 is connected to the tub 20 via the connection pipe 53 connected to a lower part of the detergent supply device 70. Thus, water supplied via the water supply pipe 51 passes through the detergent supply device 70 and is supplied to the tub 20 via the connection pipe 53. In this configuration, water supplied to the tub 20 passes through the detergent supply device 70 so that detergent inside the detergent supply device 70 may be supplied to the tub 20 together with water.

In addition, the washing machine 1 in accordance with the embodiment includes a water level sensor 80 installed in the tub 20.

The water level sensor 80 detects a frequency that varies according to a water level, so as to detect the amount (level) of water in the tub 20.

Figure 2:
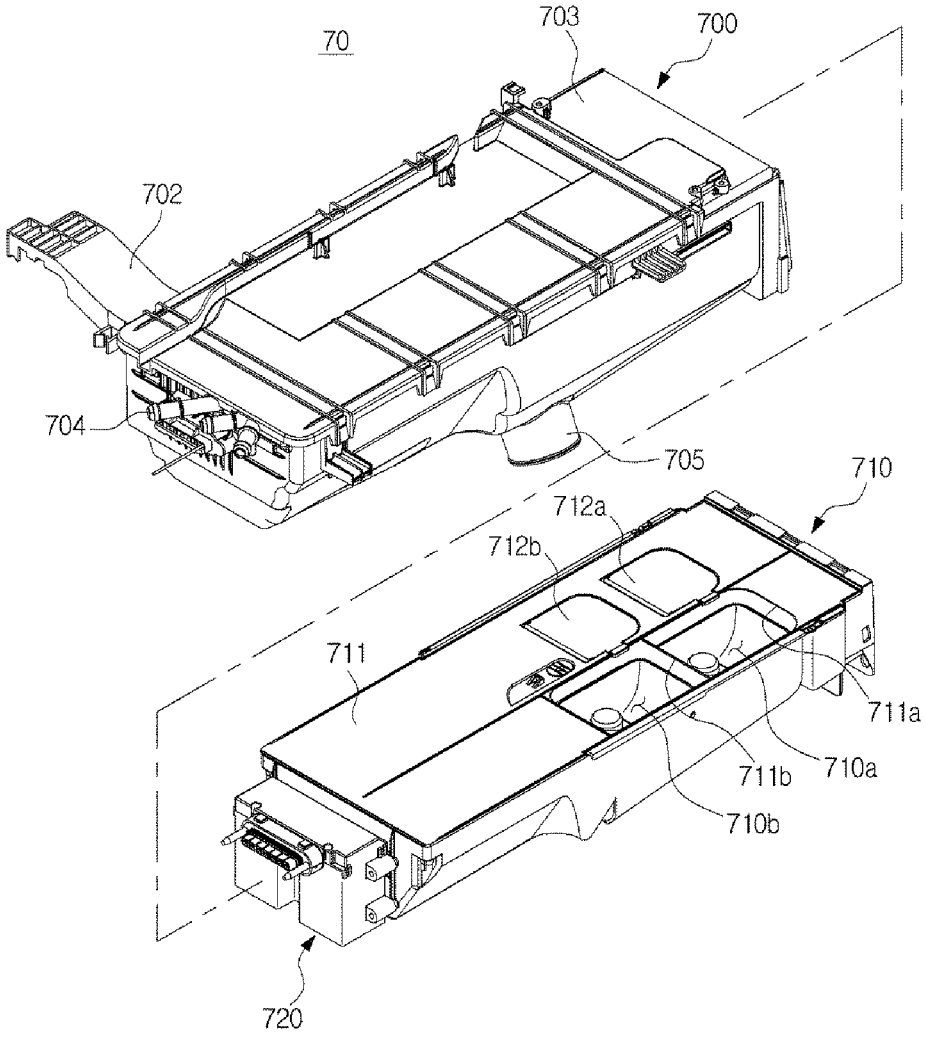
FIG. 2 is a perspective view of a detergent supply device of the washing machine illustrated in FIG. 1.

FIG. 2 is a perspective view of the detergent supply device 70 of the washing machine 1 illustrated in FIG. 1.

Referring to FIG. 2, the detergent supply device 70 includes a detergent box 710 in which detergent is put, and a detergent box housing 700 in which the detergent box 710 is accommodated.

The detergent box housing 700 is fixedly mounted on the main body 10 of the washing machine 1, and the detergent box 710 slides into the detergent box housing 700 through an opening formed in front of the detergent box housing 700 and is mounted on the detergent supply device 70. Thus, detergent is put into the washing machine 1 in such a way that a user separates only the detergent box 710 from the detergent box housing 700, puts detergent in the detergent box 710 and then mounts the detergent box 710 on the detergent box housing 700 again.

The detergent box housing 700 includes a fixing part 702 for fixing the detergent box housing 700 to the main body 10 and a housing cover 703 that covers an upper side of the detergent box housing 700. A plurality of water supply ports 704 to which the water supply pipe 51 is connected, are disposed at an upper part of a rear end of the detergent box housing 700, and a connection port 705 to which the connection pipe 53 is connected, is disposed at a lower part of the detergent box housing 700.

A plurality of detergent storing parts 710*a* and 710*b* in which detergent is stored, are disposed in the detergent box 710. Liquid or powdered detergent, and a fabric softener may be put into the plurality of detergent storing parts 710*a* and 710*b*. In accordance with the drawings, the plurality of detergent storing parts 710*a* and 710*b* are classified into a main detergent storing part 710*a* in which liquid, main detergent is accommodated, and a sub detergent storing part 710*b* in which liquid, sub detergent, such as a conditioner or bleaching agent, is stored. Although not shown, the plurality of detergent storing parts 710*a* and 710*b* further include a powdered detergent storing part in which powdered detergent is stored, and a manual detergent supply part that enables the user himself/herself to supply the conditioner or bleaching agent.

A detergent box cover 711 is mounted on an upper part of the detergent box 710 so as to prevent detergent put in the detergent box 710 from overflowing. A plurality of detergent putting-in ports 711*a* and 711*b* through which detergent may be put into each of the detergent storing parts 710*a* and 710*b*, are disposed at the detergent box cover 711, and storing part covers 712*a* and 712*b* are disposed at the main detergent storing part 710*a* in which a large amount of liquid detergent is stored and the sub detergent storing part 710*b*, so as to prevent liquid detergent from overflowing.

The detergent supply device 70 further includes a detergent putting-in module 720 that causes liquid detergent stored in the detergent box 710 to be put into the detergent box housing 700 so that liquid detergent may be mixed with water within the detergent box housing 700 and may be supplied into the tub 20 together with water.

The detergent putting-in module 720 is installed to communicate with the detergent box 710 and is installed at an outer side of the detergent box 710 in such a way that no electrical connection structures exist in the detergent box 710. In the embodiment, the detergent putting-in module 720 is installed at a rear side of the detergent box 710.

Figure 3:
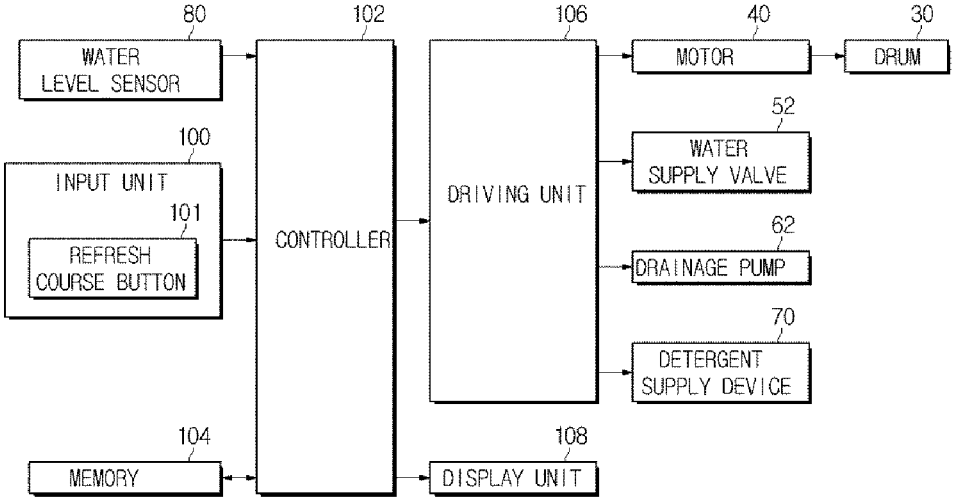
FIG. 3 illustrates a control configuration of the washing machine of FIG. 1.

FIG. 3 illustrates a control configuration of the washing machine 1 illustrated in FIG. 1.

Referring to FIG. 3, the washing machine 1 of FIG. 1 includes an input unit 100, a controller 102, a memory 104, a driving unit 106, and a display unit 108.

The input unit 100 inputs instructions for performing a washing operation, a rinsing operation, and a dehydration operation of the washing machine 1 by user's manipulation. The input unit 100 includes a key, a button, a switch, and a touchpad and includes all devices that generate input data by manipulation, such as a push, a touch, pressurization, and rotation.

Also, the input unit 100 includes a plurality of buttons (power, reserve, temperature of washing water, soak, wash, rinse, dehydrate, detergent type, and the like) that input user's instructions regarding an operation of the washing machine 1. The plurality of buttons includes a course selection button for selecting a washing course (a plurality of washing courses include a standard course, a wool course, and a delicate course, for example, a standard course selected by the user according to the type of laundry) according to the type of laundry put into the washing machine 1.

The course selection button disposed on the input unit 100 includes a refresh course button 101 for selecting a refresh washing course in which laundry that is hardly contaminated, i.e., clothes that are kept for a long time without being worn or laundry having a low degree of contamination due to a short wearing time, is washed.

When a large amount of clothes that are kept for a long time without being worn are washed at one time during the change of seasons, the refresh course button 101 is additionally provided to put a very small amount (about 10 g) of detergent quantified regardless of the weight of laundry and to change an algorithm for a washing operation and a rinsing operation according to the amount of detergent put-in.

The controller 102 is a microcomputer that controls an overall operation of the washing machine 1, such as washing, rinsing, and dehydration, according to operating information input from the input unit 100. The controller 102 sets a target washing water level and a target rinsing water level, a target revolutions per minute (rpm) and a motor operating rate (motor on-off time), washing and rinsing times, and a detergent putting-in amount (in detail, a detergent putting-in time) according to the weight (load amount) of laundry in the selected washing course.

Also, the controller 102 controls the detergent supply device 70 so as to automatically put detergent when the washing operation is performed.

In addition, the controller 102 controls the detergent supply device 70 so as to prevent overuse of detergent caused by excessive detergent putting-in, the occurrence of excessive bubbles, failure in dehydration, and degrading of rinsing efficiency by stopping automatically putting detergent when detergent is automatically put, i.e., when the user puts detergent manually without recognizing automatic detergent putting-in.

The controller 102 also controls the detergent supply device 70 so as to put a very small amount (about 10 g) of detergent uniformly quantified when the refresh washing course is performed.

That is, when the refresh washing course is selected, the controller 102 controls the detergent supply device 70 to perform the washing operation by putting the very small amount (about 10 g) of detergent quantified regardless the weight of laundry without putting the amount of detergent set according to the weight (load amount) of laundry.

The controller 102 also controls the water supply valve 52 to supply a relatively large amount of water than in the standard washing course when the refresh washing course is performed.

That is, when the refresh washing course is selected, the controller 102 controls the water supply device 50 to perform the washing operation by supplying a relatively large amount (a water level that corresponds to about ⅓ of the height of the tub 20) of water than at a target washing water level set according to the weight (load amount) of laundry. On the other hand, when the rinsing operation is performed, the controller 102 controls the water supply device 50 to prevent the use of excessive water by supplying water at a target rinsing water level set according to the weight (load amount) of laundry. Even in the rinsing operation, an algorithm may be changed to supply a relatively large amount of water than at the target rinsing water level set according to the weight (load amount) of laundry. This may be changed by a designer as needed.

The controller 102 controls the motor 40 to rotate the drum 30 at a low operating rate (motor on-off time) when the refresh washing course is performed.

That is, when the refresh washing course is selected, the controller 102 controls the motor 40 to perform the washing operation and the rinsing operation by driving the motor 40 at a lower operating rate (about 30 to 40% compared to the standard washing course) than an operating rate (motor on-off time) set according to the weight (load amount) of laundry.

In addition, when the refresh washing course is performed, the controller 102 omits an intermediate dehydration operation after the washing operation has been completed and controls the motor 40 by reducing an intermediate dehydration rpm (intermediate dehydration speed) after the rinsing operation has been completed.

That is, when the refresh washing course is selected, the controller 102 drives the motor 40 by reducing the intermediate dehydration rpm after the rinsing operation by a lower rpm (about 500 rpm) than the intermediate dehydration rpm (about 950 rpm) of the standard washing course.

Alternatively, when the refresh washing course is performed, the controller 102 controls the motor 40 by reducing the intermediate dehydration rpm (intermediate dehydration speed) after the washing operation has been completed and omits the intermediate dehydration operation after the rinsing operation has been completed.

That is, when the refresh washing course is selected, the controller 102 drives the motor 40 by reducing the intermediate dehydration rpm after the washing operation by a lower rpm (about 500 rpm) than the intermediate dehydration rpm (about 950 rpm) of the standard washing course.

Alternatively, when the refresh washing course is performed, the controller 102 omits all of the intermediate dehydration operation after the washing operation has been completed and the intermediate dehydration operation after the rinsing operation has been completed.

Alternatively, when the refresh washing course is performed, the controller 102 controls the motor 40 by reducing an intermediate dehydration rpm (intermediate dehydration speed) after the washing operation has been completed and an intermediate dehydration rpm (intermediate dehydration speed) after the rinsing operation has been completed.

That is, when the refresh washing course is selected, the controller 102 drives the motor 40 by reducing the intermediate dehydration rpm after the washing operation and the intermediate dehydration rpm after the rinsing operation by a lower rpm (about 500 rpm) than the intermediate dehydration rpm (about 950 rpm) of the standard washing course.

In addition, when the refresh washing course is performed, the controller 102 controls the washing operation and the rinsing operation so as to reduce the entire washing time by reducing the washing and rinsing times.

Setting information, such as control data used to control an operation of the washing machine 1, reference data used during control of the operation of the washing machine 1, operating data generated while the washing machine 1 performs a predetermined operation, and setting data input by the input unit 100 so that the washing machine 1 may perform the predetermined operation, usage information including the number of times at which the washing machine 1 performs a certain operation and model information of the washing machine 1, and malfunction information including a cause or position of malfunction when the washing machine 1 malfunctions may be stored in the memory 104.

The driving unit 106 drives the motor 40 relating to the operation of the washing machine 1, the water supply valve 52, the drainage pump 62, and the detergent supply device 70 in response to a driving control signal of the controller 102.

The display unit 108 displays an operating state of the washing machine 1 and a user's manipulation state in response to a display control signal of the controller 102.

Hereinafter, the operations and effects of a method of controlling the washing machine 1 having the detergent supply device of FIG. 1, in accordance with an embodiment will be described.

When clothes that are kept for a long time without being worn or laundries that are hardly contaminated due to a short wearing time are washed, the user wants washing of a refresh concept having no purpose of removing contamination adsorbed into laundry but removing various smell (for example, humid smell, food smell, meat smell, and the like) or mold that permeates laundry (clothes). Thus, in the present disclosure, a washing course of the refresh concept that may satisfy the user's need will be described with reference to FIGS. 4 through 8.

First, the case where an intermediate dehydration operation is performed after both the washing operation and the rinsing operation have been completed, so as to perform refresh washing will be described with reference to FIG. 4.

Figure 4:
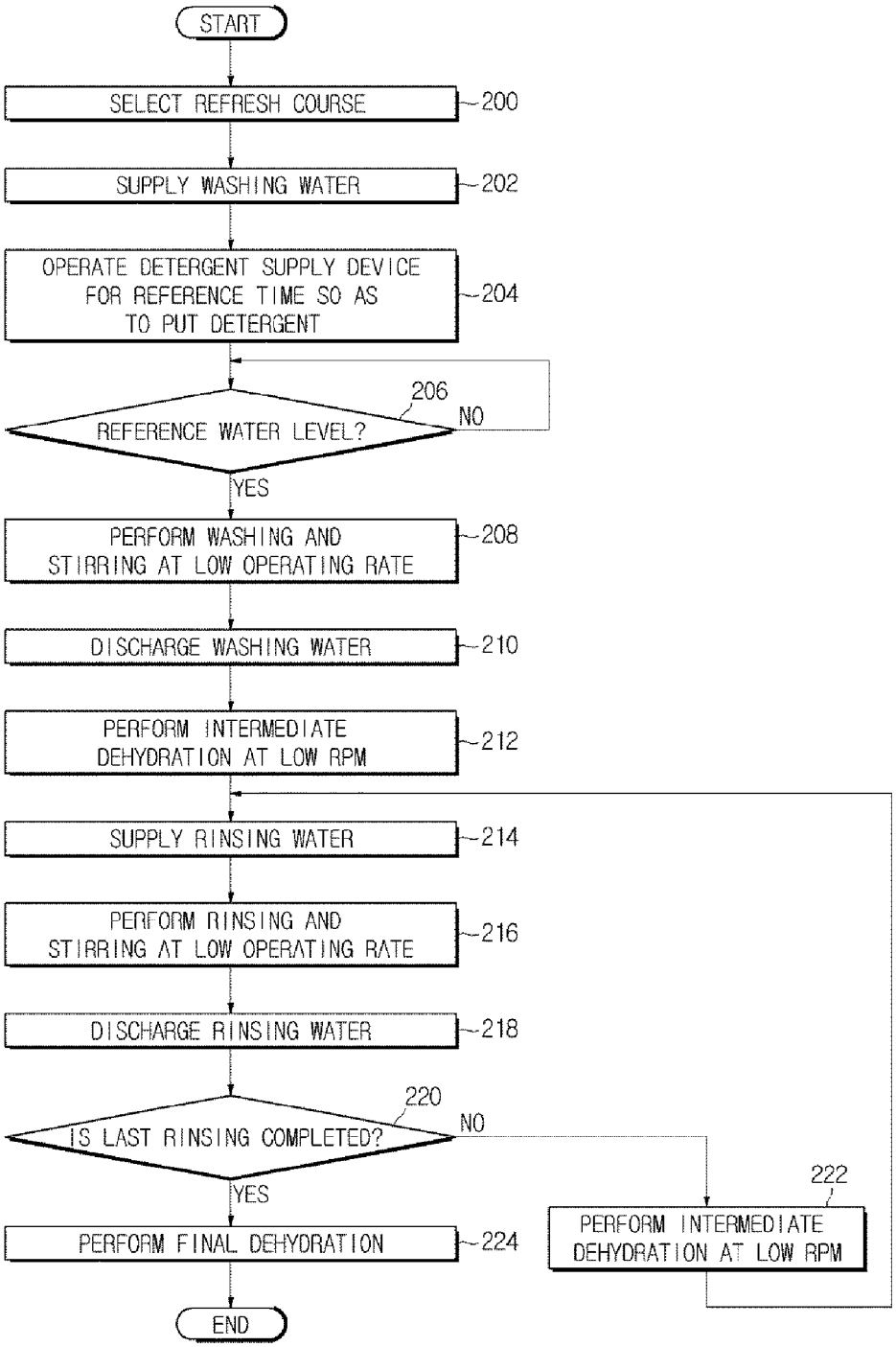
FIG. 4 is an operating flowchart illustrating a control algorithm for performing refresh washing using the washing machine having the detergent supply device of FIG. 1.

FIG. 4 is an operating flowchart illustrating a control algorithm for performing refresh washing using the washing machine 1 having the detergent supply device of FIG. 1, wherein the control algorithm has the purpose of removing various smell or mold that permeates laundry.

Figure 8:
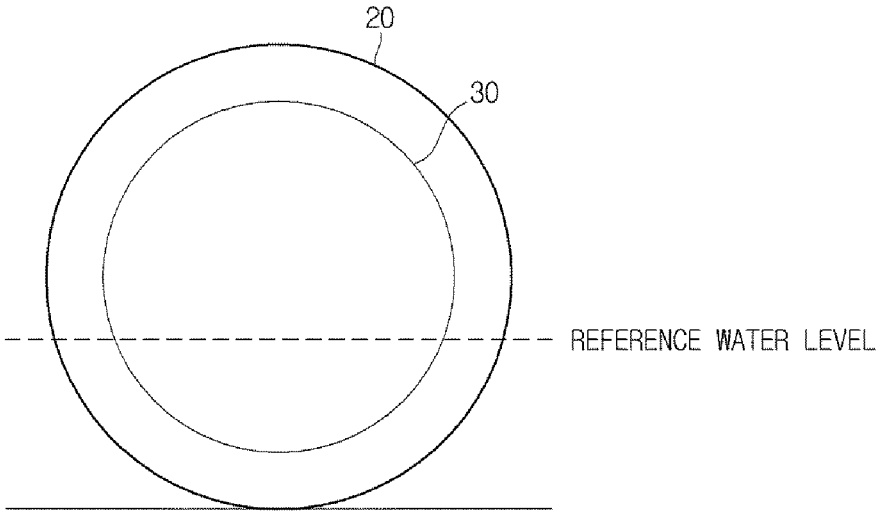
FIG. 8 illustrates a washing water level applied so as to perform refresh washing using the washing machine having the detergent supply device of FIG. 1.

FIG. 8 illustrates a washing water level applied so as to perform refresh washing using the washing machine 1 having the detergent supply device of FIG. 1.

Referring to FIG. 4, when the user selects the refresh course button 101 disposed at the input unit 100 by putting laundry to be refresh-washed into the drum 30 (Operation 200), operating information selected by the user is input to the controller 102 via the input unit 100. The amount of laundry to be put into the drum 30 depends on the user, and a large amount of clothes may be put into the drum 30 at one time during the change of seasons. Thus, the amount of laundry to be put does not need to be considered in the refresh washing course.

Next, the controller 102 operates the water supply valve 52 and the detergent supply device 70 using the driving unit 106 so as to supply water (washing water) required in the refresh washing course.

When the water supply valve 52 operates, the water supply valve 52 is opened, and water (washing water) passes through the water supply pipe 51 and the detergent supply device 70 and is supplied to the tub 20 together with detergent (Operation 202).

In this case, the amount of detergent supplied to the tub 20 together with washing water may be only a very small amount (about 10 g) of detergent, because laundry that is hardly contaminated is washed.

Thus, the controller 102 counts time at which the detergent supply device 70 operates, determines whether a reference time (time at which a very small amount of detergent required in the refresh washing course is put, about 10 seconds) elapses, so as to put the very small amount of detergent, and operates the detergent supply device 70 so as to put detergent for the reference time (Operation 204).

If the reference time elapses, the controller 102 stops the detergent supply device 70 so as to stop putting detergent.

Subsequently, the controller 102 detects a water level at which water is supplied to the tub 20 using the water level sensor 80 and determines whether the water level at which water is supplied to the tub 20 is a reference water level (a water level determined according to the amount of washing set for the refresh washing course) (Operation 206), and continuously performs a water supply operation until the water level at which water is supplied to the tub 20 reaches the reference water level. The reference water level is a water level at which washing water is supplied up to about ⅓ of the height of the tub 20, as illustrated in FIG. 8, and is the amount of water (about 25 to 26 l) supplied up to the volume of about ⅓ compared to the volume of the washing machine 1. The reference water level is not limited to the amount of water supplied up to the volume of about ⅓ compared to the volume of the washing machine 1 and may be an appropriate water level at which laundry may be fully soaked like in the delicate or the wool course.

That is, the amount of water supplied in the refresh washing course may be greater than or equal to the amount of water supplied in the delicate course (or wool course).

When the supply of washing water is completed up to the reference water level, the controller 102 drives the motor 40 at a low operating rate (motor on-off time) so as to stir and rotate the drum 30, thereby performing the refresh washing operation (Operation 208).

Since the refresh washing operation is in a state in which the very small amount of detergent is input through the detergent supply device 70 so as to wash laundry that is hardly contaminated, an operating rate in the refresh washing course is relatively low compared to the case where detergent set according to the weight (load amount) of laundry is put in the standard washing course.

That is, since desired washing performance may be obtained without performing washing at the operating rate (motor on-off time) set according to the weight of laundry, the refresh washing operation is performed by setting the operating rate (motor on-off time) of the refresh washing course to about 30 to 40% compared to the standard washing course.

When refresh washing is completed for a set washing time (about 15 minutes), the controller 102 stops the drum 30 and discharges washing water in which detergent is contained (Operation 210), and performs intermediate dehydration at a low rpm (about 500 rpm or less) at which damage of laundry does not occur (Operation 212).

In this case, the washing time (about 15 minutes) in the refresh washing course is relatively shorter than a washing time in the standard washing course. The washing time in the standard washing course is at least 30 minutes or more when the weight of laundry is assumed to be 10 kg; however, the washing time in the refresh washing course is within maximum 15 minutes regardless of the weight of laundry. When the user selects the refresh washing course so as to wash a large amount of clothes at one time during the change of seasons, the washing time in the refresh washing course is much shorter than the washing time in the standard washing course. This is because, the very small amount of detergent is put so as to perform refresh washing.

Consequently, in the refresh washing operation, a relatively low operating rate of 30 to 40% (motor on-off time) compared to the operating rate for the standard washing course, intermediate dehydration at the relatively low rpm of 500 compared to 950 rpm for the standard washing course, and a washing profile in which various smell or mold that permeates laundry may be removed for a short washing time (about 3 minutes) and damage of laundry may be minimized, are implemented. The operating rate in the refresh washing operation is low like in the delicate or wool course. In the refresh washing operation, laundry is washed at the low operating rate in a state in which laundry is fully soaked, like in the delicate or wool course.

Subsequently, the controller 102 operates the water supply valve 52 so as to supply water (rinsing water) required for refresh rinsing, thereby performing a refresh rinsing operation.

When the water supply valve 52 operates, the water supply valve 52 is opened, water (rinsing water) passes through the water supply pipe 51 and is supplied to the tub 20 (Operation 214).

Thus, the controller 102 detects the water level at which water is supplied to the tub 20, using the water level sensor 80, determines whether the detected water level is a target rinsing water level (water level determined according to a set amount of rinsing), and continuously performs a water supply operation until the water level at which water is supplied to the tub 20 reaches the target rinsing water level.

In the refresh rinsing operation, supplying water at the target rinsing water level set according to the weight (load amount) of laundry is to prevent the use of excessive water, because desired rinsing performance may be sufficiently obtained even when rinsing is performed at the set target rinsing water level. Of course, the designer may change an algorithm so as to supply a relatively large amount of water compared to the set target rinsing water level even in the rinsing operation as needed.

In other words, the rinsing water level at which water is supplied so as to perform the refresh rinsing operation may be set to be less than or equal to a reference water level at which water is supplied so as to perform the refresh washing operation. This is because desired washing performance is obtained through the refresh washing operation. Thus, in the refresh rinsing operation, even when the amount of supplied water is about ½ or less than the amount of water supplied in the refresh washing operation, desired rinsing performance may be sufficiently obtained.

When the supply of rinsing water is completed up to the target rinsing water level, the controller 102 drives the motor 40 at the low operating rate (motor on-off time) so as to stir and rotate the drum 30, thereby performing the refresh rinsing operation (Operation 216).

Since the refresh rinsing operation is in a state in which a very small amount of detergent is put through the detergent supply device 70 so as to wash laundry that is hardly contaminated, desired rinsing performance may be sufficiently obtained even when rinsing is not performed at the operating rate (motor on-off time) set according to the weight of laundry. Thus, the refresh rinsing operation is performed by setting the operating rate (motor on-off time) for the refresh washing course to about 30 to 40% compared to the standard washing course.

When refresh rinsing is completed for a set rinsing time (about 3 minutes), the controller 102 stops the drum 30 and discharges rinsing water (Operation 218). Refresh rinsing is performed at a defined number of times, and the number of times being rinsed for the refresh washing course is set to be less than or equal to the number of times (about two times) being rinsed for the standard washing course.

This is to prevent the use of excessive water considering that desired rinsing performance may be sufficiently obtained even when rinsing is performed at the smaller number of times than the number of times (about two times) being rinsed for the standard washing course. Of course, the designer may change the number of times being rinsed as needed.

Subsequently, the controller 102 determines whether last rinsing is completed (Operation 220), and if it is determined that last rinsing is not completed, intermediate dehydration is performed at the low rpm (about 500 rpm or less) at which damage of laundry does not occur (Operation 222), and the first control algorithm illustrated in FIG. 4 feeds back to Operation 214, and operations after Operation 214 are performed.

Consequently, in the refresh rinsing operation, the relatively low operating rate (motor on-off time) of 30 to 40% compared to the operating rate for the standard washing course, intermediate dehydration at the relatively low rpm of 500 compared to 950 rpm for the standard washing course, and a rinsing profile in which various smell or mold that permeates laundry may be removed for a short rinsing time (about 3 minutes) and damage of laundry may be minimized, are implemented.

As a result of determination in Operation 220, if it is determined that last rinsing is completed, the controller 102 performs a dehydration operation at a set final dehydration rpm (about 1000 rpm or less) (Operation 224).

Hereinafter, the case where intermediate dehydration is performed only after the washing operation has been completed and intermediate dehydration is not performed after the rinsing operation has been completed, so as to perform refresh washing, will be described with reference to FIG. 5.

Figure 5:
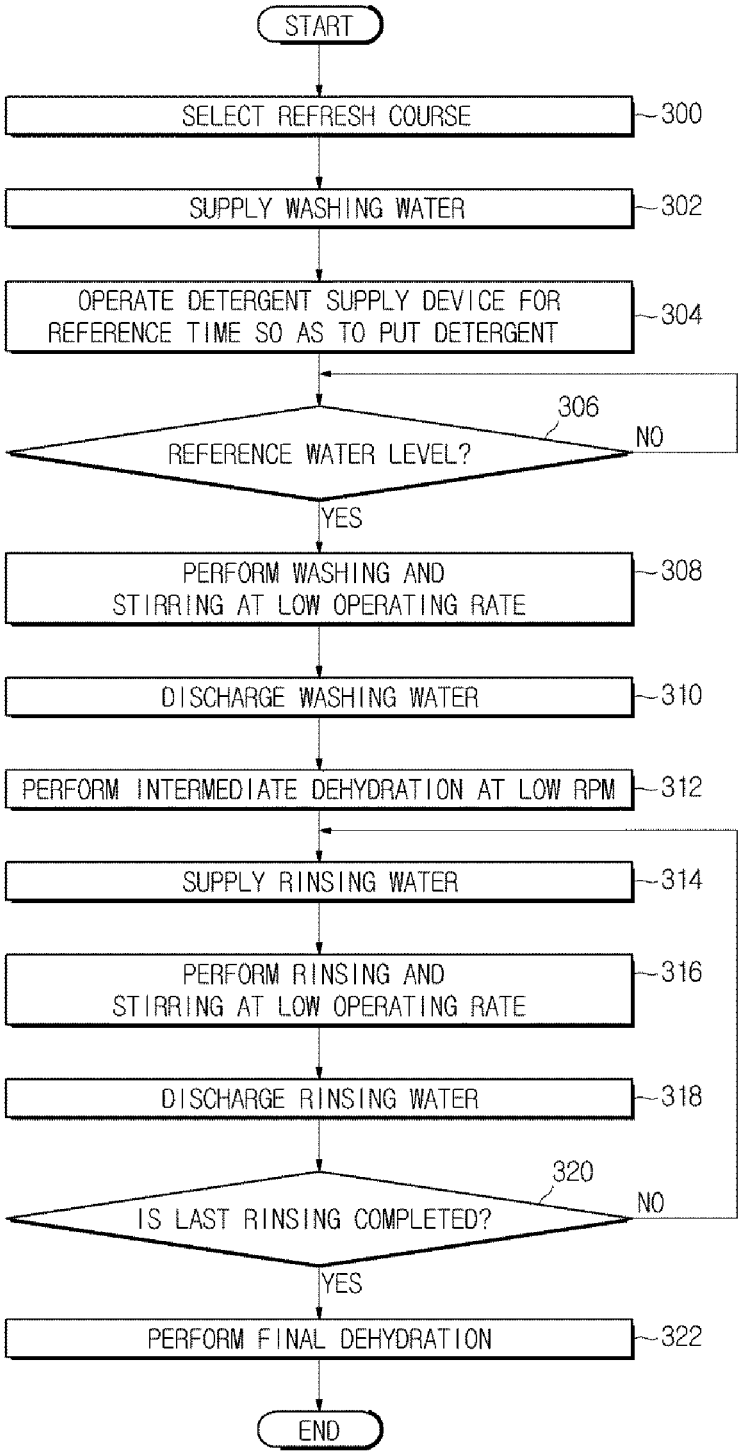
FIG. 5 is an operating flowchart illustrating a control algorithm for performing refresh washing using the washing machine having the detergent supply device of FIG. 1.

FIG. 5 is an operating flowchart illustrating a control algorithm for performing refresh washing using the washing machine 1 having the detergent supply device of FIG. 1. Descriptions of the same portions as those of FIG. 4 will be omitted to the utmost.

Referring to FIG. 5, when the user puts laundry to be refresh-washed into the drum 30 and selects the refresh course button 101 disposed at the input unit 100 (Operation 300), operating information selected by the user is input to the controller 102 through the input unit 100.

Next, the controller 102 operates the water supply valve 52 and the detergent supply device 70 using the driving unit 106 so as to supply water (washing water) required for the refresh washing course.

When the water supply valve 52 operates, the water supply valve 52 is opened, and water (washing water) passes through the water supply pipe 51 and the detergent supply device 70 and is supplied to the tub 20 together with detergent (Operation 302).

In this case, the amount of detergent supplied to the tub 20 together with washing water may be a very small amount (about 10 g) of detergent, because laundry that is hardly contaminated is washed.

Thus, the controller 102 operates the detergent supply device 70 for a reference time (time at which a very small amount of detergent required for the refresh washing course is put, about 10 seconds) so as to put the very small amount of detergent (Operation 304).

The controller 102 detects the water level at which water is supplied to the tub 20 using the water level sensor 80 and determines whether the detected water level is a reference water level (water level determined according to the amount of washing set for the refresh washing course) (Operation 306), and continuously performs a water supply operation until the water level at which water is supplied to the tub 20 reaches the reference water level.

If it is determined that the supply of washing water is completed up to the reference water level, the controller 102 drives the motor 40 at a low operating rate (motor on-off time) so as to stir and rotate the drum 30, thereby performing the refresh washing operation (Operation 308).

When refresh washing is completed for a set washing time (about 15 minutes), the controller 102 stops the drum 30 and discharges washing water in which detergent is contained (Operation 310), and performs intermediate dehydration at a low rpm (about 500 rpm or less) at which damage of laundry does not occur (Operation 312).

Consequently, in the refresh washing operation, a relatively low operating rate (motor on-off time) of 30 to 40% compared to the operating rate for the standard washing course, intermediate dehydration at a relatively low rpm of 500 compared to 950 rpm for the standard washing course, and a washing profile in which various smell or mold that permeates laundry may be removed for a short washing time (about 3 minutes) and damage of laundry may be minimized, are implemented.

Subsequently, the controller 102 operates the water supply valve 52 so as to supply water (rinsing water) required for refresh rinsing, thereby performing the refresh rinsing operation.

When the water supply valve 52 operates, the water supply valve 52 is opened, and water (rinsing water) passes through the water supply pipe 51 and is supplied to the tub 20 (Operation 314).

Thus, the controller 102 detects a water level at which water is supplied to the tub 20, using the water level sensor 80, determines whether the detected water level is a target rinsing water level (water level determined according to a set amount of rinsing), and continuously performs a water supply operation until the water level at which water is supplied to the tub 20 reaches the target rinsing water level.

If the supply of rinsing water is completed up to the target rinsing water level, the controller 102 drives the motor 40 at a low operating rate (motor on-off time) so as to stir and rotate the drum 30, thereby performing the refresh rinsing operation (Operation 316).

If refresh rinsing is completed for a set rinsing time (about 3 minutes), the controller 102 stops the drum 30 and discharges rinsing water (Operation 318). The refresh rinsing operation is performed at a defined number of times, and the number of times being rinsed for the refresh washing course is set to be less than or equal to the number of times (about two times) being rinsed for the standard washing course.

This is to prevent the use of excessive water considering that desired rinsing performance may be sufficiently obtained even when rinsing is performed at a smaller number of times than the number of times (about two times) being rinsed for the standard washing course. Of course, the designer may change the number of times being rinsed as needed.

Next, the controller 102 determines whether last rinsing is completed (Operation 320), and if it is determined that last rinsing is not completed, intermediate dehydration is not performed, and the second control algorithm illustrated in FIG. 5 feeds back to Operation 314, and operations after Operation 314 are performed.

Consequently, in the refresh rinsing operation, a relatively low operating rate (motor on-off time) of 30 to 40% compared to the operating rate for the standard washing course, and a rinsing profile in which various smell or mold that permeates laundry may be removed for a short rinsing time (about 3 minutes) and damage of laundry may be minimized, are implemented.

As a result of determination in Operation 320, if it is determined that last rinsing is completed, the controller 102 performs a dehydration operation at a set final dehydration rpm (about 1000 rpm or less) (Operation 322). The intermediate dehydration step is omitted between the refresh rinse operation and the final dehydration operation Hereinafter, the case where intermediate dehydration is not performed after both the washing operation and the rinsing operation have been completed, so as to perform refresh washing, will be described with reference to FIG. 6.

Figure 6:
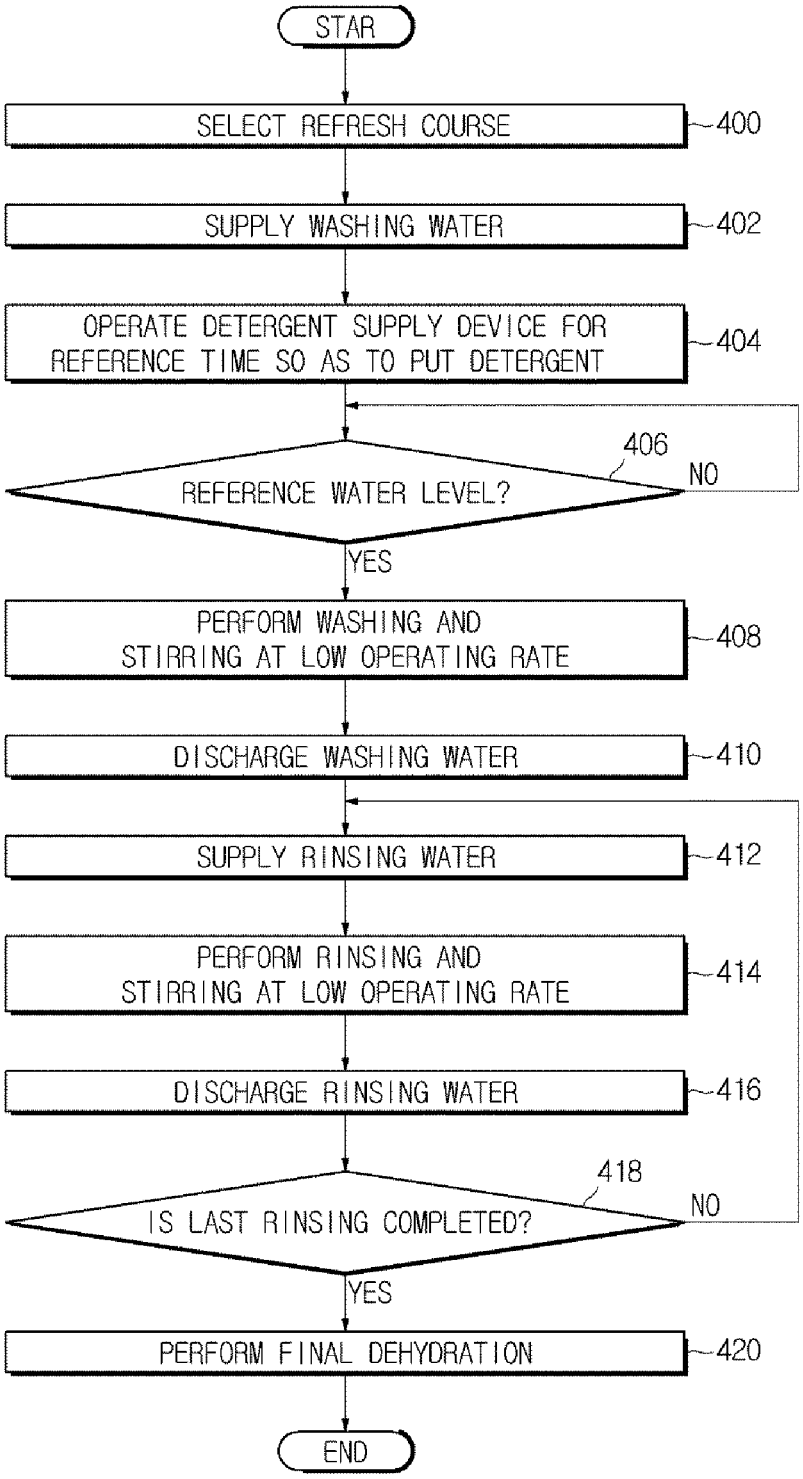
FIG. 6 is an operating flowchart illustrating a control algorithm for performing refresh washing using the washing machine having the detergent supply device of FIG. 1.

FIG. 6 is an operating flowchart illustrating a control algorithm for performing refresh washing using the washing machine 1 having the detergent supply device of FIG. 1. Descriptions of the same portions as those of FIG. 6 will be omitted to the utmost.

Referring to FIG. 6, when the user puts laundry to be refresh-washed into the drum 30 and selects the refresh course button 101 disposed at the input unit 100 (Operation 400), operating information selected by the user is input to the controller 102 through the input unit 100.

Next, the controller 102 operates the water supply valve 52 and the detergent supply device 70 using the driving unit 106 so as to supply water (washing water) required for the refresh washing course.

When the water supply valve 52 operates, the water supply valve 52 is opened, and water (washing water) passes through the water supply pipe 51 and the detergent supply device 70 and is supplied to the tub 20 together with detergent (Operation 402).

In this case, the amount of detergent supplied to the tub 20 together with washing water may be a very small amount (about 10 g) of detergent, because laundry that is hardly contaminated is washed.

Thus, the controller 102 operates the detergent supply device 70 for a reference time (time at which a very small amount of detergent required for a refresh washing course is put, about 10 seconds) so as to put the very small amount of detergent (Operation 404).

The controller 102 detects a water level at which water is supplied to the tub 20 using the water level sensor 80 and determines whether the detected water level is a reference water level (water level determined according to the amount of washing set for the refresh washing course) (Operation 406), and continuously performs a water supply operation until the water level at which water is supplied to the tub 20 reaches the reference water level.

If it is determined that the supply of washing water is completed up to the reference water level, the controller 102 drives the motor 40 at a low operating rate (motor on-off time) so as to stir and rotate the drum 30, thereby performing the refresh washing operation (Operation 408).

When refresh washing is completed for a set washing time (about 15 minutes), the controller 102 stops the drum 30 and discharges washing water in which detergent is contained (Operation 410), and does not perform intermediate dehydration.

Consequently, in the refresh washing operation, a relatively low operating rate (motor on-off time) of 30 to 40% compared to the operating rate for the standard washing course, and a washing profile in which various smell and mold that permeates laundry may be removed for a short washing time (about 3 minutes) and damage of laundry may be minimized, are implemented. The intermediate dehydration step is omitted between the refresh washing operation and the refresh rinse operation.

Subsequently, the controller 102 operates the water supply valve 52 so as to supply water (rinsing water) required for refresh rinsing, thereby performing the refresh rinsing operation.

When the water supply valve 52 operates, the water supply valve 52 is opened, and water (rinsing water) passes through the water supply pipe 51 and is supplied to the tub 20 (Operation 412).

Thus, the controller 102 detects a water level at which water is supplied to the tub 20, using the water level sensor 80, determines whether the detected water level is a target rinsing water level (water level determined according to a set amount of rinsing), and continuously performs a water supply operation until the water level at which water is supplied to the tub 20 reaches the target rinsing water level.

If the supply of rinsing water is completed up to the target rinsing water level, the controller 102 drives the motor 40 at a low operating rate (motor on-off time) so as to stir and rotate the drum 30, thereby performing the refresh rinsing operation (Operation 414).

If refresh rinsing is completed for a set rinsing time (about 3 minutes), the controller 102 stops the drum 30 and discharges rinsing water (Operation 416), and determines whether last rinsing is completed (Operation 418).

As a result of determination in Operation 418, if it is determined that last rinsing is not completed, intermediate dehydration is not performed, and the control algorithm illustrated in FIG. 6 feeds back to Operation 412, and operations after Operation 412 are performed.

Consequently, in the refresh rinsing operation, a relatively low operating rate (motor on-off time) of 30 to 40% compared to the operating rate for the standard washing course, and a rinsing profile in which various smell or mold that permeates laundry may be removed for a short rinsing time (about 3 minutes) and damage of laundry may be minimized, are implemented. The intermediate dehydration step is omitted between the refresh rinse operation and the final dehydration operation As a result of determination in Operation 418, if it is determined that last rinsing is completed, the controller 102 performs a dehydration operation at a set final dehydration rpm (about 1000 rpm or less) (Operation 420).

Hereinafter, the case where intermediate dehydration is not performed after the washing operation has been completed but intermediate dehydration is performed only after the rinsing operation has been completed, so as to perform refresh washing will be described with reference to FIG. 7.

Figure 7:
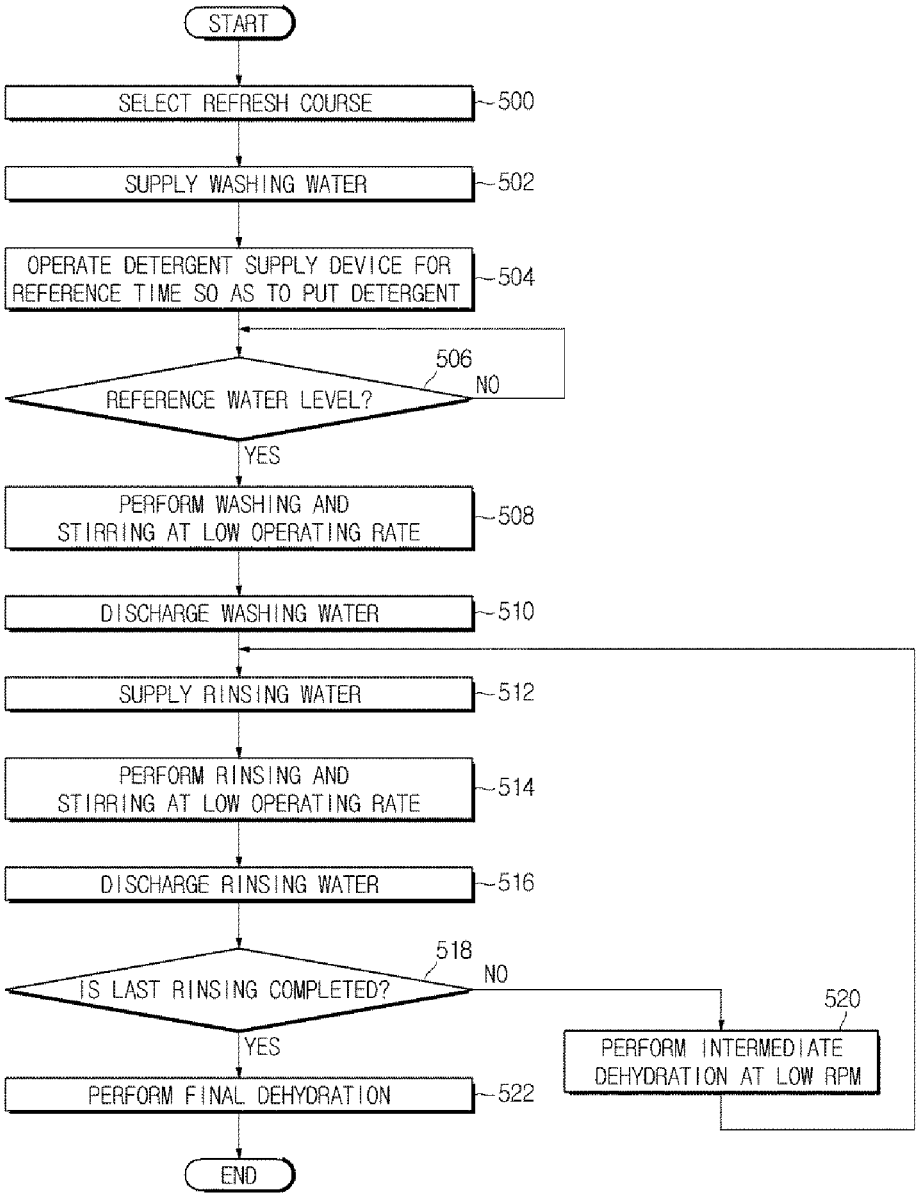
FIG. 7 is an operating flowchart illustrating a control algorithm for performing refresh washing using the washing machine having the detergent supply device of FIG. 1.

FIG. 7 is an operating flowchart illustrating a control algorithm for performing refresh washing using the washing machine 1 having the detergent supply device of FIG. 1. Descriptions of the same portions as those of FIGS. 4 through 6 will be omitted to the utmost.

Referring to FIG. 7, when the user puts laundry to be refresh-washed into the drum 30 and selects the refresh course button 101 disposed at the input unit 100 (Operation 500), operating information selected by the user is input to the controller 102 through the input unit 100.

Next, the controller 102 operates the water supply valve 52 and the detergent supply device 70 using the driving unit 106 so as to supply water (washing water) required for the refresh washing course.

When the water supply valve 52 operates, the water supply valve 52 is opened, and water (washing water) passes through the water supply pipe 51 and the detergent supply device 70 and is supplied to the tub 20 together with detergent (Operation 502).

In this case, the amount of detergent supplied to the tub 20 together with washing water may be a very small amount (about 10 g) of detergent, because laundry that is hardly contaminated is washed.

Thus, the controller 102 operates the detergent supply device 70 for a reference time (time at which a very small amount of detergent required for a refresh washing course is put, about 10 seconds) so as to put the very small amount of detergent (Operation 504).

The controller 102 detects a water level at which water is supplied to the tub 20 using the water level sensor 80 and determines whether the detected water level is a reference water level (water level determined according to the amount of washing set for the refresh washing course) (Operation 506), and continuously performs a water supply operation until the water level at which water is supplied to the tub 20 reaches the reference water level.

If it is determined that the supply of washing water is completed up to the reference water level, the controller 102 drives the motor 40 at a low operating rate (motor on-off time) so as to stir and rotate the drum 30, thereby performing the refresh washing operation (Operation 508).

When refresh washing is completed for a set washing time (about 15 minutes), the controller 102 stops the drum 30 and discharges washing water in which detergent is contained (Operation 510), and does not perform intermediate dehydration.

Consequently, in the refresh washing operation, a relatively low operating rate (motor on-off time) of 30 to 40% compared to the operating rate for the standard washing course, and a washing profile in which various smell and mold that permeates laundry may be removed for a short washing time (about 3 minutes) and damage of laundry may be minimized, are implemented. The intermediate dehydration step is omitted between the refresh washing operation and the refresh rinse operation Subsequently, the controller 102 operates the water supply valve 52 so as to supply water (rinsing water) required for refresh rinsing, thereby performing the refresh rinsing operation.

When the water supply valve 52 operates, the water supply valve 52 is opened, and water (rinsing water) passes through the water supply pipe 51 and is supplied to the tub 20 (Operation 512).

Thus, the controller 102 detects a water level at which water is supplied to the tub 20, using the water level sensor 80, determines whether the detected water level is a target rinsing water level (water level determined according to a set amount of rinsing), and continuously performs a water supply operation until the water level at which water is supplied to the tub 20 reaches the target rinsing water level.

If the supply of rinsing water is completed up to the target rinsing water level, the controller 102 drives the motor 40 at a low operating rate (motor on-off time) so as to stir and rotate the drum 30, thereby performing the refresh rinsing operation (Operation 514).

If refresh rinsing is completed for a set rinsing time (about 3 minutes), the controller 102 stops the drum 30 and discharges rinsing water (Operation 516), and determines whether last rinsing is completed (Operation 518).

As a result of determination in Operation 518, if it is determined that last rinsing is not completed, intermediate dehydration is performed at a low rpm (about 500 rpm or less) at which damage of laundry does not occurs (Operation 520), and the fourth control algorithm illustrated in FIG. 7 feeds back to Operation 512, and operations after Operation 512 are performed.

Also, intermediate dehydration may not be performed after washing has been completed in the refresh washing course, because the very small amount of detergent is put so as to perform refresh washing, as mentioned above.

Consequently, in the refresh rinsing operation, a relatively low operating rate (motor on-off time) of 30 to 40% compared to the operating rate for the standard washing course, intermediate dehydration at a relatively low rpm of 500 compared to 950 rpm for the standard washing course, and a rinsing profile in which various smell or mold that permeates laundry may be removed for a short rinsing time (about 3 minutes) and damage of laundry may be minimized, are implemented.

As a result of determination in Operation 518, if it is determined that last rinsing is completed, the controller 102 performs a dehydration operation at a set final dehydration rpm (about 1000 rpm or less) (Operation 522).

In the algorithms for the refresh washing course illustrated in FIGS. 4 through 7, even when intermediate dehydration is omitted or performed after the washing operation or the rising operation has been completed, an intermediate dehydration rpm is reduced to minimize damage of laundry. All of the operations can be performed by putting the very small amount of detergent.

Next, the case where refresh last rinsing is performed, will be described with reference to FIG. 9.

Figure 9:
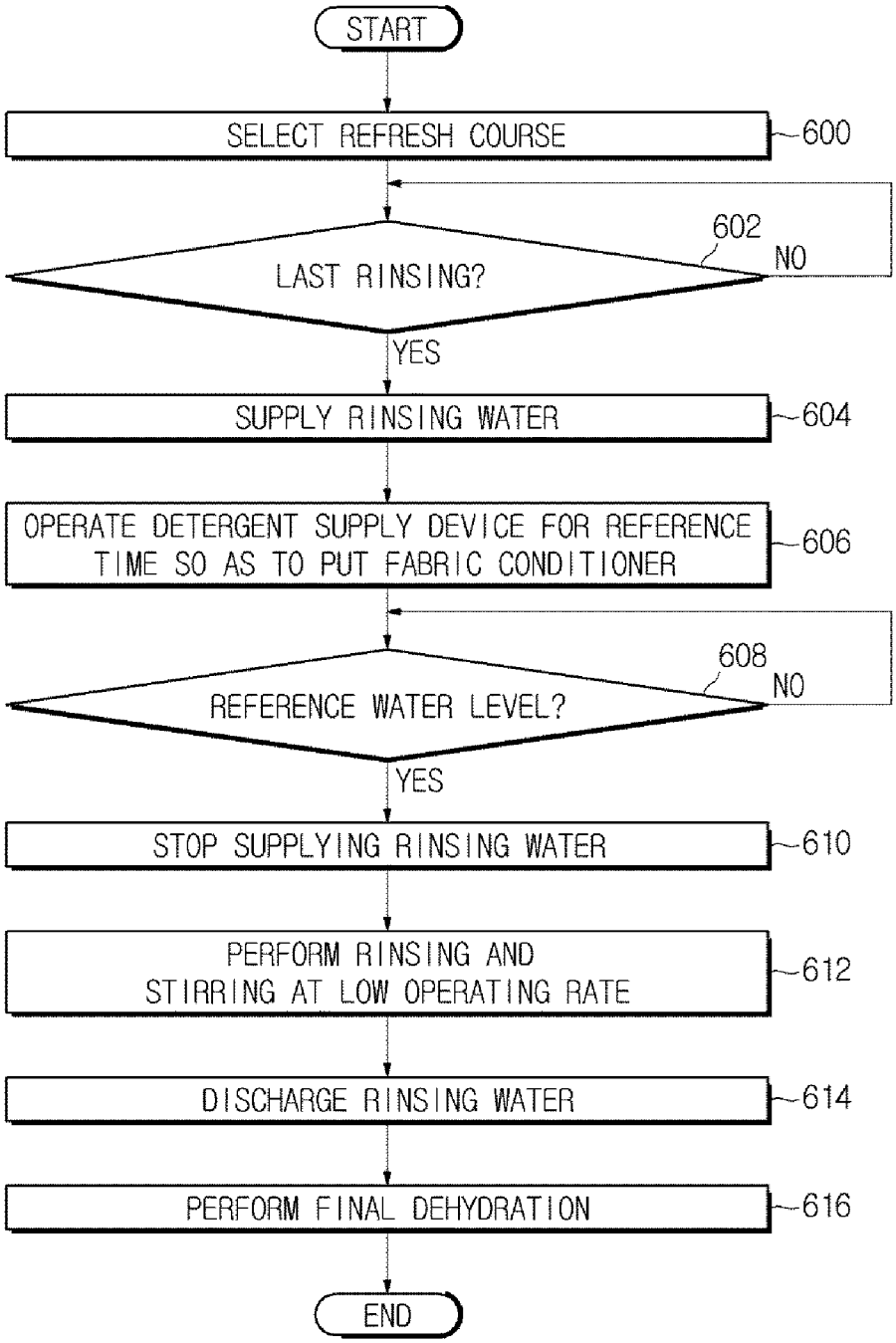
FIG. 9 is an operating flowchart illustrating a control algorithm for performing refresh last rinsing using the washing machine having the detergent supply device of FIG. 1.

FIG. 9 is an operating flowchart illustrating a control algorithm for performing refresh last rinsing using the washing machine 1 having the detergent supply device of FIG. 1.

Referring to FIG. 9, when the user puts laundry to be refresh-washed into the drum 30 and selects the refresh course button 101 disposed at the input unit 100 (Operation 600), operating information selected by the user is input to the controller 102 through the input unit 100.

Thus, the controller 102 determines whether last rinsing is performed in a refresh course (Operation 602).

As a result of determination in Operation 602, if it is determined that last rinsing is performed, the controller 102 operates the water supply valve 52 and the detergent supply device 70 using the driving unit 106 so as to supply water (rinsing water) required for refresh rinsing.

When the water supply valve 52 operates, the water supply valve 52 is opened, and water (rinsing water) passes through the water supply pipe 51 and the detergent supply device 70 and is supplied to the tub 20 together with a fabric conditioner (Operation 604).

In this case, the amount of the fabric conditioner supplied to the tub 20 together with rinsing water may be a very small amount (about 10 g), because laundry that is hardly contaminated is rinsed.

Thus, the controller 102 counts time at which the detergent supply device 70 operates, determines whether a reference time (time at which a very small amount of fabric conditioner required for refresh rinsing is put, about 10 seconds) elapses, so as to put the very small amount of fabric conditioner, and operates the detergent supply device 70 so as to put the fabric conditioner for the reference time (Operation 606).

If the reference time elapses, the controller 102 stops the detergent supply device 70 so as to stop putting the fabric conditioner.

Subsequently, the controller 102 detects a water level at which water is supplied to the tub 20 using the water level sensor 80 and determines whether the detected water level is a reference water level (water level determined according to the amount of rinsing set for refresh rinsing) (Operation 608), and continuously performs a water supply operation until the water level at which water is supplied to the tub 20 reaches the reference water level. The reference water level is a water level at which rinsing water is supplied up to about ⅓ of the height of the tub 20, as illustrated in FIG. 8, and is the amount of water supplied up to the volume of about ⅓ compared to the volume of the washing machine 1. The reference water level is not limited to the amount of water supplied up to the volume of about ⅓ compared to the volume of washing machine 1 and may be set to be less than or equal to a water level at which water is supplied for refresh washing. This is because desired washing performance has been sufficiently obtained through the refresh washing operation. Thus, even when the amount of water supplied in the refresh last rinsing operation is about ½ or less than the amount of water supplied in the refresh washing operation or the refresh rising operation, desired rinsing performance may be sufficiently obtained.

If it is determined that the supply of rinsing water is completed up to the reference water level, the controller 102 stops the water supply valve 52 so as to stop performing the rinsing water supply operation (Operation 610).

Then, the controller 102 drives the motor 40 at a low operating rate (motor on-off time) so as to stir and rotate the drum 30, thereby performing the refresh last rinsing operation (Operation 612).

The refresh last rinsing operation is in a state in which the very small amount of fabric conditioner is put using the detergent supply device 70 so as to do the laundry that is hardly contaminated. Thus, an operating rate for the refresh washing course is relatively low compared to the case where detergent set according to the weight (load amount) of laundry is put in the standard washing course.

That is, since desired rinsing performance may be obtained without performing rinsing at the operating rate (motor on-off time) set according to the weight of laundry, the refresh last rinsing operation is performed by setting the operating rate (motor on-off time) of the refresh washing course to about 30 to 40% compared to the standard washing course.

When refresh last rinsing is completed for a set rinsing time (about 3 minutes), the controller 102 stops the drum 30 and discharges rinsing water in which the fabric conditioner is contained (Operation 614), and performs a dehydration at a set final rpm (about 1000 rpm or less) (Operation 616).

A method of performing refresh washing or rinsing, whereby a very small amount of detergent or fabric conditioner is put and various smell or mold that permeates laundry may be removed, using a drum washing machine having the detergent supply device 70 has been described. However, embodiments are not limited thereto, and a full automatic washing machine 1001 having a detergent supply device 1041, as illustrated in FIG. 10, may achieve the same purposes and effects as those of the embodiment.

Figure 10:
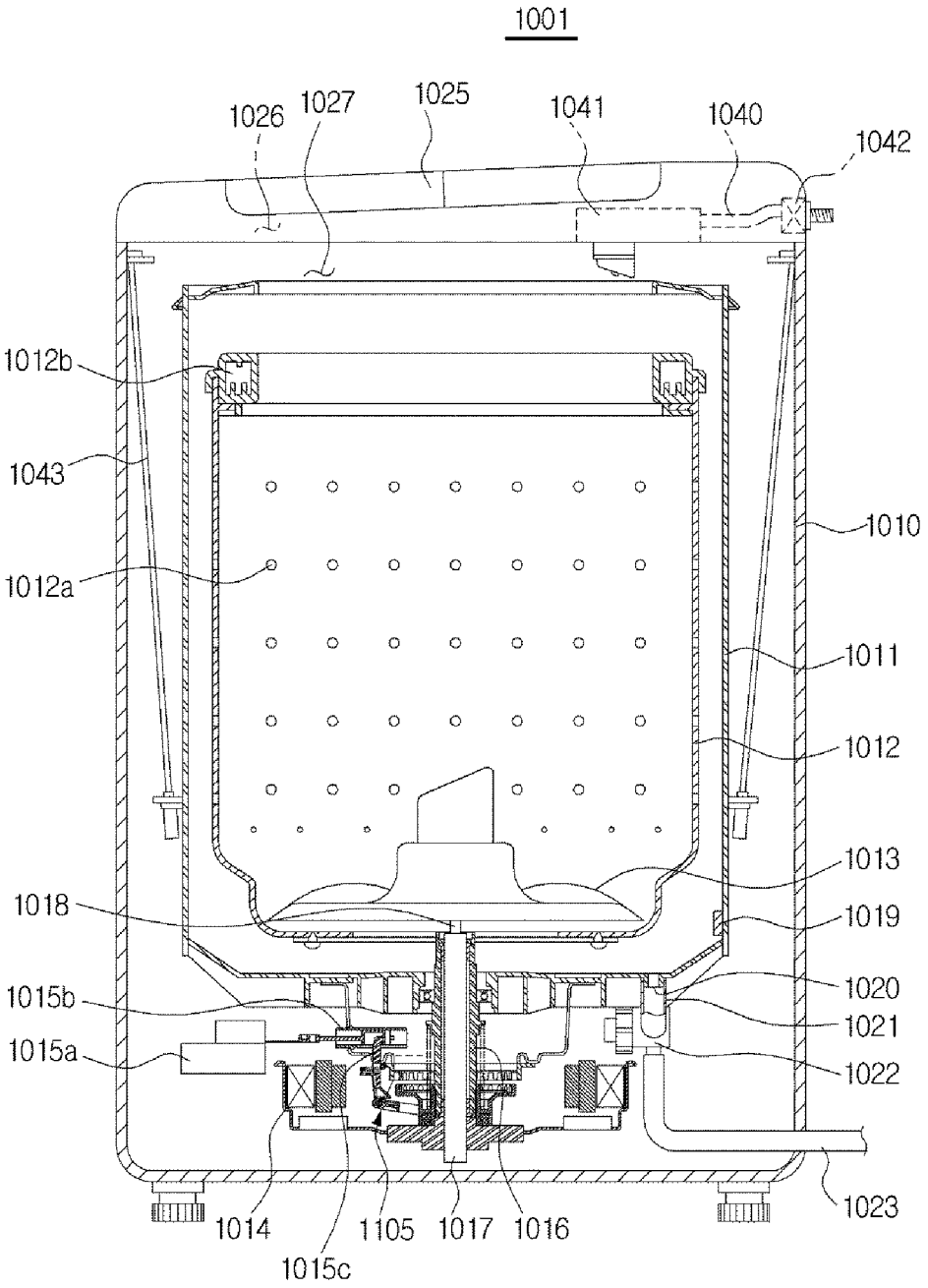
FIG. 10 is a cross-sectional view illustrating a configuration of a washing machine in accordance with an embodiment.

FIG. 10 is a cross-sectional view illustrating a configuration of a washing machine in accordance with an embodiment.

Referring to FIG. 10, a washing machine 1001 in accordance with an embodiment includes an approximately box-shaped cabinet 1010 that constitutes the exterior, a tub 1011 which is installed in the cabinet 1010 and in which water (washing or rinsing water) is stored, a washing container 1012 which is rotatably installed in the tub 1011 and in which laundry is put, and a pulsator 1013 which is rotatably installed in the washing container 1012, rotates left or right (clockwise or counterclockwise), and generates a water current.

The washing container 1012 has an opened, cylindrical upper part, and a plurality of dehydration holes 1012*a* are formed in sides of the washing container 1012. A balancer 1012*b* may be mounted on the upper part of the washing container 1012 so that the washing container 1012 may be stably rotated during high-speed rotation.

A washing motor 1014 that generates a driving force to rotate the washing container 1012 and the pulsator 1013, and a power switching device 1015 that simultaneously or selectively transmits the driving force generated by the washing motor 1014 to the washing container 1012 and the pulsator 1013, are installed outside a lower side of the tub 1011.

A hollow type dehydration shaft 1016 may be coupled to the washing container 1012, and a washing shaft 1017 installed at a hollow part of the dehydration shaft 1016 may be coupled to the pulsator 1013 through a washing shaft coupling part 1018.

The washing motor 1014 is a direct drive (DD) type of motor having a variable speed function. The washing motor 1014 may transmit the driving force to the washing container 1012 and the pulsator 1013 simultaneously or selectively according to an ascending/descending operation of the power switching device 1015.

Also, the washing motor 1014 may be a universal motor including a field coil and an armature or a brushless direct motor (BLDC) motor including a permanent magnet and an electrical magnet. The washing motor 1014 may also be any type of motor that may be applied to the washing machine 1001. In addition, the washing motor 1014 may be configured as a belt type.

The power switching device 1015 may include an actuator 1015*a* that generates a driving force for switching power, a load part 1015*b* that makes a straight motion according to an operation of the actuator 1015*a*, and a clutch part 1015*c* that is connected to the load part 1015*b* and is rotated according to an operation of the load part 1015*b*.

A water level sensor 1019 that detects a frequency that varies according to a water level so as to detect the amount (level) of water in the tub 1011, is installed inside the lower side of the tub 1011.

A drainage hole 1020 is formed in the bottom of the tub 1011 so as to discharge water in the tub 1011 to the outside, and a first drainage pipe 1021 is connected to the drainage hole 1020. A drainage motor 1022 is installed at the first drainage pipe 1021 so as to regulate drainage, and a second drainage pipe 1023 is connected to an outlet of the drainage motor 1022 so as to discharge water to the outside.

A door 1025 that is opened/closed so as to put or take out laundry into or from the washing container 1012 is installed at an upper side of the cabinet 1010, and a top cover 1026 is detached or mounted from or on the cabinet 1010 depending on whether the door 1025 is opened or closed.

A laundry port 1027 is formed on the top cover 1026 so as to put or take out laundry into or from the washing container 1012. The laundry port 1027 may be opened/closed by the door 1025.

Also, a water supply pipe 1040 is installed at an upper part of the cabinet 1010 so as to supply water to the tub 1011. One side of the water supply pipe 1040 is connected to an external water supply source, and the other side thereof is connected to a detergent supply device 1041. Water supplied through the water supply pipe 1040 passes through the detergent supply device 1041 and is supplied into the tub 1011 together with detergent. A water supply valve 1042 may be installed at the water supply pipe 1040 so as to control the supply of water.

The tub 1011 may be supported by a suspension device 1043 on the cabinet 1010.

As described above, in a washing machine having a detergent supply device and a method of controlling the same in accordance with the one or more of the above embodiments, when clothes that are kept for a long time without being worn or laundries that are hardly contaminated due to a short wearing time are washed, a refresh washing course in which various smell or mold that permeates laundry can be removed using a very small amount of detergent, is performed. Thus, overuse of detergent caused by an excessive use of detergent can be prevented, and since the necessity for rinsing is low due to the use of the very small amount of detergent, an intermediate dehydration operation may be omitted, or an intermediate dehydration revolutions per minute (rpm) may be reduced so that washing and rinsing operations do not need to be excessively performed and thus damage of laundry is reduced to increase user's satisfaction of washing.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of controlling a washing machine operable in a plurality of pre-defined washing courses, the washing machine including a controller, a detergent supply device configured to store detergent input by a user, a tub, a drum installed in the tub, a motor to rotate the drum, and a water supply device, the method comprising:

receiving a user input selecting a refresh washing course among the plurality of pre-defined washing courses, the refresh washing course including at least a washing operation, a rinsing operation, and a dehydration operation, and having default settings assigned to the washing operation in the refresh washing course, the default settings including a first amount of detergent to be supplied into the tub for the washing operation in the refresh washing course, a first amount of water to be supplied by the water supply device for the washing operation in the refresh washing course, and an operating rate of the motor for the washing operation in the refresh washing course;

controlling, by the controller, the first amount of detergent to be supplied by the detergent supply device into the tub for the washing operation in the refresh washing course among the plurality of pre-defined washing courses for a load accommodated in the drum, the first amount of detergent being a smaller amount of detergent than a second amount of detergent that would be controlled by the controller to be supplied by the detergent supply device for a same load for a washing operation in a standard washing course among the plurality of pre-defined washing courses;

supplying the first amount of water by the water supply device for the washing operation in the refresh washing course for the load, the first amount of water being a larger amount of water than a second amount of water that would be supplied by the water supply device for the same load for the washing operation in the standard washing course; and performing the washing operation in the refresh washing course by operating the motor at a lower operating rate than an operating rate that would be utilized for the same load for the washing operation in the standard washing course, wherein, in the refresh washing course, the controller controls the detergent supply device to be operated for a predetermined reference time included in the default settings, regardless of a weight of the load, to supply the first amount of detergent by the detergent supply device into the tub, and in the refresh washing course, the first amount of detergent to be supplied by the detergent supply device is a fixed uniform amount included in the default settings that does not change according to the weight of the load.

2. The method of claim 1, further comprising:

performing the rinsing operation in the refresh washing course by operating the motor at an operating rate which is less than an operating rate that would be utilized for the same load for a rinsing operation in the standard washing course, wherein an operating rate of the motor in the washing operation in the refresh washing course is about 30% to 40% less than an operating rate of the motor that would be utilized for the same load for the washing operation in the standard washing course, an operating rate of the motor in the rinsing operation in the refresh washing course is about 30% to 40% less than an operating rate of the motor that would be utilized for the same load for the rinsing operation in the standard washing course, and the refresh washing course has default settings assigned to the rinsing operation in the refresh washing course which include the operating rate of the motor for the rinsing operation in the refresh washing course.

3. The method of claim 2, wherein the dehydration operation in the refresh washing course includes an intermediate dehydration operation and a final dehydration operation, and the method further comprises:

performing the intermediate dehydration operation in the refresh washing course between completion of the washing operation in the refresh washing course and a final rinsing of the rinsing operation in the refresh washing course; and performing the final dehydration operation in the refresh washing course upon completion of the final rinsing of the rinsing operation in the refresh washing course, wherein a number of revolutions per minute of the motor in the intermediate dehydration operation in the refresh washing course is about half a number of revolutions per minute of the motor that would be utilized for the same load for an intermediate dehydration operation in the standard washing course performed between completion of the washing operation in the standard washing course and a final rinsing of the rinsing operation in the standard washing course, and the refresh washing course has default settings assigned to the dehydration operation which include the number of revolutions per minute of the motor in the intermediate dehydration operation in the refresh washing course.

4. The method of claim 1, wherein a time to perform the washing operation in the refresh washing course is a fixed uniform amount of time that is included in the default settings, and is set without regard to a weight of the load.

5. The method of claim 4, wherein the fixed uniform amount of time to perform the washing operation in the refresh washing course is less than half an amount of time to perform the washing operation in the standard washing course for the same load.

6. The method of claim 1, wherein the plurality of pre-defined washing courses further include a delicate washing course and a wool washing course, the delicate washing course and the wool washing course each having different default settings from each other and from the refresh washing course and the standard washing course.

7. A method of controlling a washing machine operable in a plurality of pre-defined washing courses, the washing machine including a controller, a detergent supply device configured to store detergent input by a user, a tub, a drum installed in the tub, a motor to rotate the drum, and a water supply device, the method comprising:

receiving a user input selecting a refresh washing course among the plurality of pre-defined washing courses, the refresh washing course including at least a washing operation, a rinsing operation, and a dehydration operation, and having default settings assigned to the rinsing operation in the refresh washing course, the default settings including a first amount of fabric conditioner to be supplied into the tub for the rinsing operation in the refresh washing course, a first amount of water to be supplied by the water supply device for the rinsing operation in the refresh washing course, and an operating rate of the motor for the rinsing operation in the refresh washing course;

controlling, by the controller, the first amount of fabric conditioner to be supplied by the detergent supply device into the tub for the rinsing operation in the refresh washing course for a load accommodated in the drum, the first amount of fabric conditioner being a smaller amount of fabric conditioner than a second amount of fabric conditioner that would be controlled by the controller to be supplied by the detergent supply device for a rinsing operation in a standard washing course among the plurality of pre-defined washing courses;

supplying the first amount of water by the water supply device for the rinsing operation in the refresh washing course for the load, the first amount of water being a larger amount of water than a second amount of water that would be supplied by the water supply device for the same load for the rinsing operation in the standard washing course; and performing the rinsing operation in the refresh washing course by operating the motor at a lower operating rate than an operating rate that would be utilized for the same load for the rinsing operation in the standard washing course, wherein, in the refresh washing course, the controller controls the detergent supply device to be operated for a predetermined reference time included in the default settings, regardless of a weight of the load, to supply the first amount of fabric conditioner by the detergent supply device into the tub, and in the refresh washing course, the first amount of fabric conditioner to be supplied by the detergent supply device is a fixed uniform amount included in the default settings that does not change according to the weight of the load.

8. A method of controlling a washing machine operable in a plurality of pre-defined washing courses, the washing machine including a controller, a detergent supply device configured to store detergent input by a user, a tub, a drum installed in the tub, a motor to rotate the drum, and a water supply device, the method comprising:

receiving a user input selecting a refresh washing course among the plurality of pre-defined washing courses, the refresh washing course including at least a washing operation, a rinsing operation, and a dehydration operation, and having default settings assigned to the washing operation in the refresh washing course, the default settings including a first amount of detergent to be supplied into the tub for the washing operation in the refresh washing course, a first amount of water to be supplied by the water supply device for the washing operation in the refresh washing course, and an operating rate of the motor for the washing operation in the refresh washing course;

controlling, by the controller, the first amount of detergent to be supplied by the detergent supply device into the tub for the washing operation in the refresh washing course among the plurality of pre-defined washing courses for a load accommodated in the drum, the first amount of detergent being a smaller amount of detergent than would be controlled by the controller to be supplied by the detergent supply device for a same load for a washing operation in a standard washing course among the plurality of pre-defined washing courses;

supplying the first amount of water by the water supply device for the washing operation in the refresh washing course for the load, the first amount of water being a larger amount of water than a second amount of water that would be supplied by the water supply device for the same load for the washing operation in the standard washing course;

performing the washing operation in the refresh washing course by operating the motor at a lower operating rate than an operating rate that would be utilized for the same load for the washing operation in the standard washing course;

draining at least a portion of the first amount of water when the washing operation in the refresh washing course is complete;

performing the rinsing operation in the refresh washing course by supplying a third amount of water by the water supply device, the third amount of water being equal to a fourth amount of water that would be supplied by the water supply device for the same load for the rinsing operation in the standard washing course; and performing an intermediate dehydration operation in the refresh washing course after completion of at least one of the washing operation in the refresh washing course and the rinsing operation in the refresh washing course, wherein the intermediate dehydration operation is performed at a rotational speed that is about half a rotational speed that an intermediate dehydration operation in the standard washing course is performed at for the same load, in the refresh washing course, the controller controls the detergent supply device to be operated for a predetermined reference time included in the default settings, regardless of a weight of the load, to supply the first amount of detergent by the detergent supply device into the tub, and in the refresh washing course, the first amount of detergent to be supplied by the detergent supply device is a fixed uniform amount included in the default settings that does not change according to the weight of the load.

9. A method of controlling a washing machine operable in a plurality of pre-defined washing courses, the washing machine including a controller, a detergent supply device configured to store detergent input by a user, a tub, a drum installed in the tub, a motor to rotate the drum, and a water supply device, the method comprising:

receiving a user input selecting a refresh washing course among the plurality of pre-defined washing courses, the refresh washing course including at least a washing operation, a rinsing operation, and a dehydration operation, and having default settings assigned to the washing operation in the refresh washing course, the default settings including a first amount of detergent to be supplied into the tub for the washing operation, a first amount of water to be supplied by the water supply device for the washing operation, and an operating rate of the motor for the washing operation;

controlling, by the controller, the first amount of detergent to be supplied by the detergent supply device into the tub for the washing operation in the refresh washing course among the plurality of pre-defined washing courses for a load accommodated in the drum, the first amount of detergent being a smaller amount of detergent than a second amount of detergent that would be controlled by the controller to be supplied by the detergent supply device for a same load for a washing operation in a standard washing course among the plurality of pre-defined washing courses;

supplying the first amount of water by the water supply device for the washing operation in the refresh washing course for the load, the first amount of water being a larger amount of water than a second amount of water that would be supplied by the water supply device for the same load for the washing operation in the standard washing course;

performing the washing operation in the refresh washing course by operating the motor at an operating rate which is less than an operating rate that would be utilized for the same load for the washing operation in the standard washing course;

supplying a third amount of water by the water supply device for the rinsing operation in the refresh washing course for the load, the third amount of water being determined according to a weight of the load; and performing the rinsing operation in the refresh washing course by operating the motor at an operating rate which is less than an operating rate that would be utilized for the same load for a rinsing operation in the standard washing course, wherein in the refresh washing course, the first amount of detergent to be supplied by the detergent supply device is a fixed uniform amount included in the default settings that does not change based on a weight of the load, and in the refresh washing course, the first amount of water supplied for the washing operation by the water supply device corresponds to a fixed reference water level included in the default settings which is not determined according to the weight of the load.

* * * * *